US006036576A

United States Patent [19]

Colon, Jr.

[11] Patent Number: 6,036,576

[45] Date of Patent: Mar. 14, 2000

[54] LIGHT SWORD TOY WITH MOVING INTERNAL OBJECT

[76] Inventor: Gilbert Colon, Jr., 424 E. 13th St. #7, New York, N.Y. 10009

[21] Appl. No.: 09/132,071

[22] Filed: Aug. 10, 1998

[51] Int. Cl.[7] ..... A63H 33/22

[52] U.S. Cl. ..... 446/473; 446/170; 446/485

[58] Field of Search ..... 446/170, 438, 446/439, 473, 485, 489; 362/109, 351, 360, 806

[56] References Cited

U.S. PATENT DOCUMENTS

| | | | |
|---|---|---|---|
| 3,391,935 | 7/1968 | Gross | 446/485 |
| 3,950,890 | 4/1976 | Kittell | 446/485 |
| 4,072,855 | 2/1978 | Marchese . | |
| 4,120,116 | 10/1978 | Williams . | |
| 4,157,627 | 6/1979 | Tschelisnik . | |
| 4,208,701 | 6/1980 | Schock | 362/202 |
| 4,231,077 | 10/1980 | Joyce | 362/32 |
| 4,588,387 | 5/1986 | Swenson | 446/485 |
| 4,678,450 | 7/1987 | Scolari | 446/405 |
| 4,904,222 | 2/1990 | Gastgeb | 446/405 |
| 5,256,099 | 10/1993 | Rudell | 446/473 |
| 5,279,513 | 1/1994 | Connelly | 446/219 |
| 5,321,591 | 6/1994 | Cimock | 362/186 |

*Primary Examiner*—Robert A. Hafer
*Assistant Examiner*—Jeffrey D. Carlson
*Attorney, Agent, or Firm*—Goldstein & Canino

[57] ABSTRACT

A light sword toy comprising a tube having a proximal end and a distal end, and a light source located at the proximal end of the tube. The light source directs light into the tube toward the distal end. The tube is made of a translucent material which glows when the light source is activated. A ball is contained within the tube, and is capable of moving between the proximal end and distal end thereof. When the ball is initially at the proximal end, it blocks nearly all of the light from the light source from reaching the distal end. When the ball is subsequently rolled toward the distal end, the illumination appears to travel toward the distal end. A ball retaining mechanism is located at the distal end for holding the ball at the distal end until the end of play. Then the ball is releasable by the user to restore the ball to the proximal end of the tube.

6 Claims, 5 Drawing Sheets

LIGHT SWORD TOY WITH MOVING INTERNAL OBJECT

BACKGROUND OF THE INVENTION

The invention relates to a light sword toy. More particularly, the invention relates to a light sword which has a movable object within the sword portion thereof which moves longitudinally within the sword portion to create a visual effect.

Since the movie "STAR WARS" was released in 1977, the concept of a sword made of light has captivated the imagination of both children and adults. Thus, toys have been developed which attempt to mimic the light sword with a flashlight and a colored, translucent tube attached thereto. When the flashlight is turned on, the tube generates a subtle glow. Some of the tubes even generate sound when swung through the air.

U.S. Pat. No. 5,279,513 to Connely discloses a toy sword which contains means to provide focused light. Connely also refers to a scrolling feature, but provides no exemplative mechanism for allowing the light to travel along the sword.

U.S. Pat. No. 4,231,077 to Joyce discloses a light toy comprised of a flashlight and tube with a reflective surface inside the cap.

U.S. Pat. No. 5,245,099 to Rudell et al. discloses a contact-activated pressurized water release toy. The toy contains a quantity of pressurized water which is subsequently released during play.

U.S. Pat. No. 4,208,701 to Schock discloses a transparent elongated toy which internally reflects light to create different visual effects.

U.S. Pat. No. 4,904,222 to Gastgeb; U.S. Pat. No. 4,678,450 to Scolari; and U.S. Pat. No. 5,321,591 to Cimock each disclose different light sword toys.

While these units may be suitable for the particular purpose employed, or for general use, they would not be as suitable for the purposes of the present invention as disclosed hereafter.

SUMMARY OF THE INVENTION

It is an object of the invention to produce a light sword toy which provides the appearance of a sword made of a beam of light. Accordingly, the sword toy comprises a flashlight-like light source which acts as a handle, and a translucent tube attached to the light source which is illuminated by the light source to create a glowing effect.

It is another object of the invention to produce a light sword toy which creates an interesting visual effect. Accordingly, a movable object is contained within the tube for blocking, deflecting, refracting, or otherwise altering the light emanating from the tube to create the appearance of moving light through the tube.

It is a further object of the invention to produce a light sword toy which employs a movable ball, the ball retained within the tube and capable of freely sliding longitudinally within the tube.

It is a still further object of the invention to provide a light sword toy which employs a ball retaining means at distal end of the tube, to selectively hold the ball thereat during play, and then subsequently releasing it and allowing it to travel back toward the proximal end of the tube.

The invention is a light sword toy comprising a tube having a proximal end and a distal end, and a light source located at the proximal end of the tube. The light source directs light into the tube toward the distal end. The tube is made of a translucent material which glows when the light source is activated. A ball is contained within the tube, and is capable of moving between the proximal end and distal end thereof. When the ball is initially at the proximal end, it blocks nearly all of the light from the light source from reaching the distal end. When the ball is subsequently rolled toward the distal end, the illumination appears to travel toward the distal end. A ball retaining mechanism is located at the distal end for holding the ball at the distal end until the end of play. Then the ball is releasable by the user to restore the ball to the proximal end of the tube.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
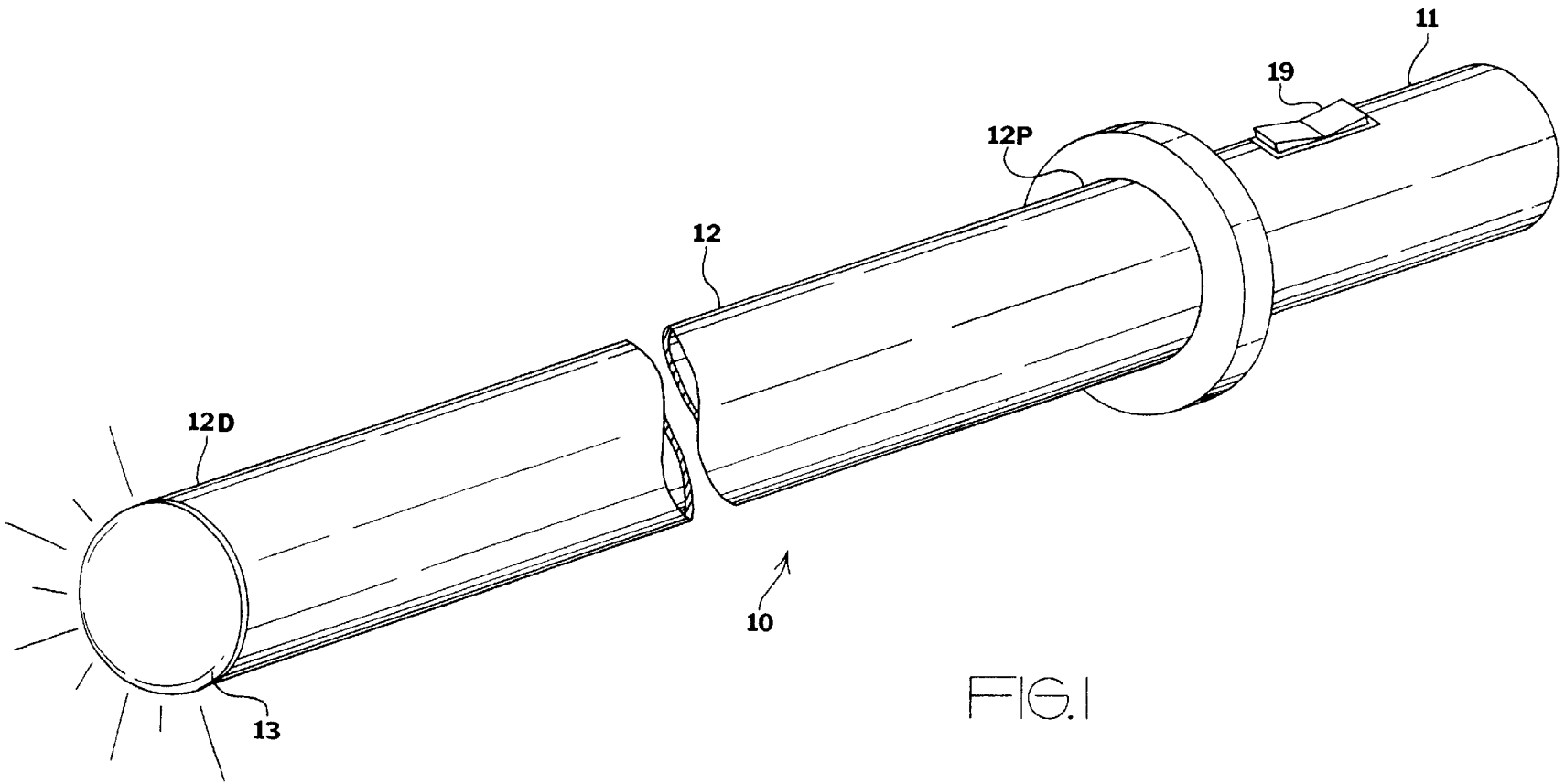
FIG. 1 is a diagrammatic perspective view of the light sword per se.

FIG. 1 illustrates a light sword toy 10, comprising a light source 11 and a tube 12. The tube 12 has a proximal end 12P and a distal end 12D. The light source 11 is attached to the tube 12 at its proximal end 12P. A cap assembly 13 is located at the distal end 12D of the tube 12. A switch 19 is provided for activating the light source 11.

The tube is generally made of plastic, and is translucent. The tube 12 is illustrated in FIG. 1 as having arbitrary length. It is contemplated that the tube 12 would typically be considerably longer than the length seemingly indicated in FIG. 1.

Figure 2:
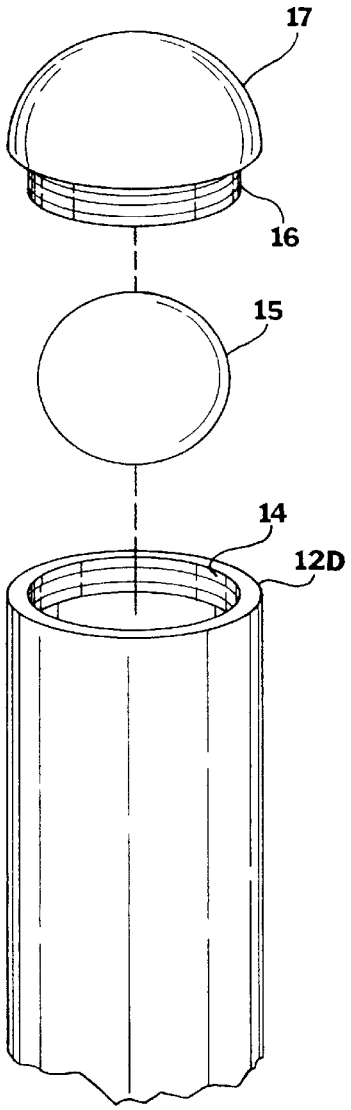
FIG. 2 is an assembly drawing, illustrating the cap assembly being installed at the distal end of the tube.

FIG. 2 illustrates that the tube 12 is open at the distal end 12D, and has an internal proximal thread 14 thereat. A ball 15 is inserted into the distal end 12D, and becomes trapped within the tube 12. The ball 15 is opaque. The tube 12 is closed at the distal end 12D by inserting the cap assembly 13. The cap assembly 13 has a lower threaded portion 16 which mates with the internal proximal thread 14 of the tube 12. The cap assembly 13 also has a dome portion 17.

Figure 3:
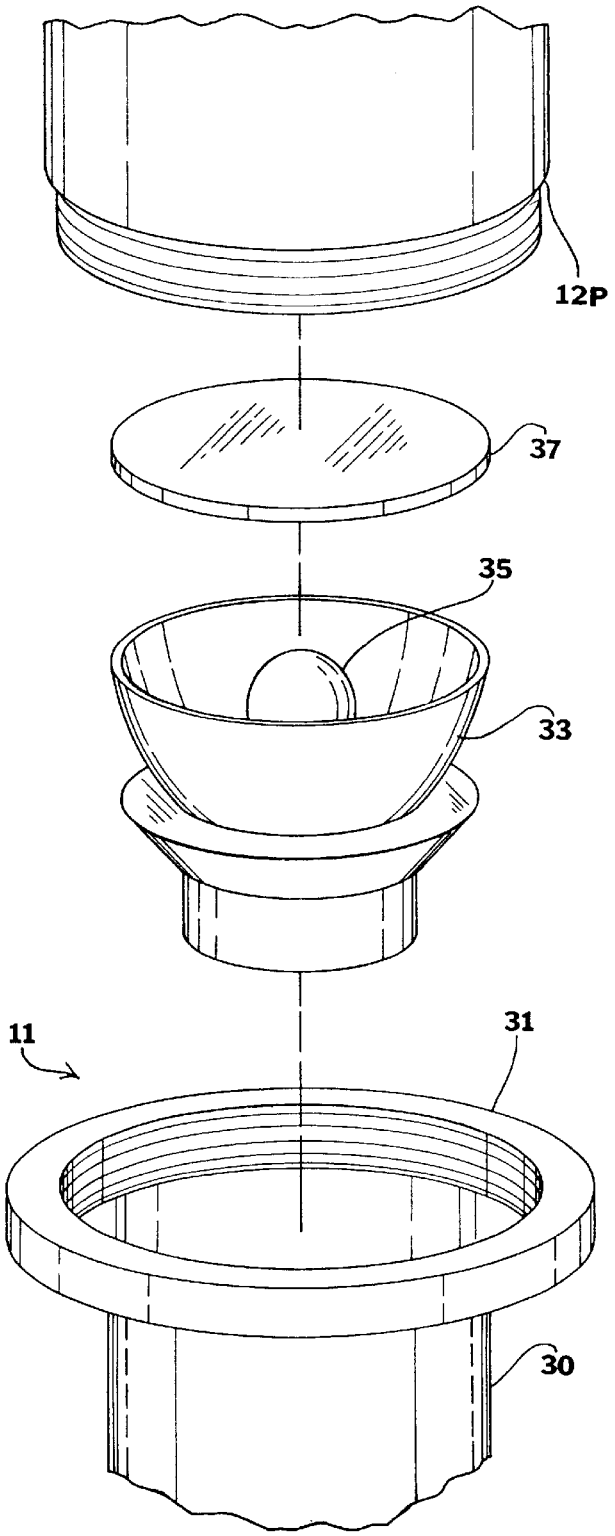
FIG. 3 is an assembly drawing, illustrating components of the light source being assembled, and then the proximal end of the tube being attached thereto.

FIG. 3 illustrates the light source 11, which comprises a hollow handle 30, having a top flange 31. The light source 11 further comprises a reflector assembly 33, containing a bulb 35. The reflector assembly 33 is covered with a bulb cover 37. Also illustrated in FIG. 3, the proximal end 12P of the tube 12 is about to be attached to the top flange 31.

Figure 4:
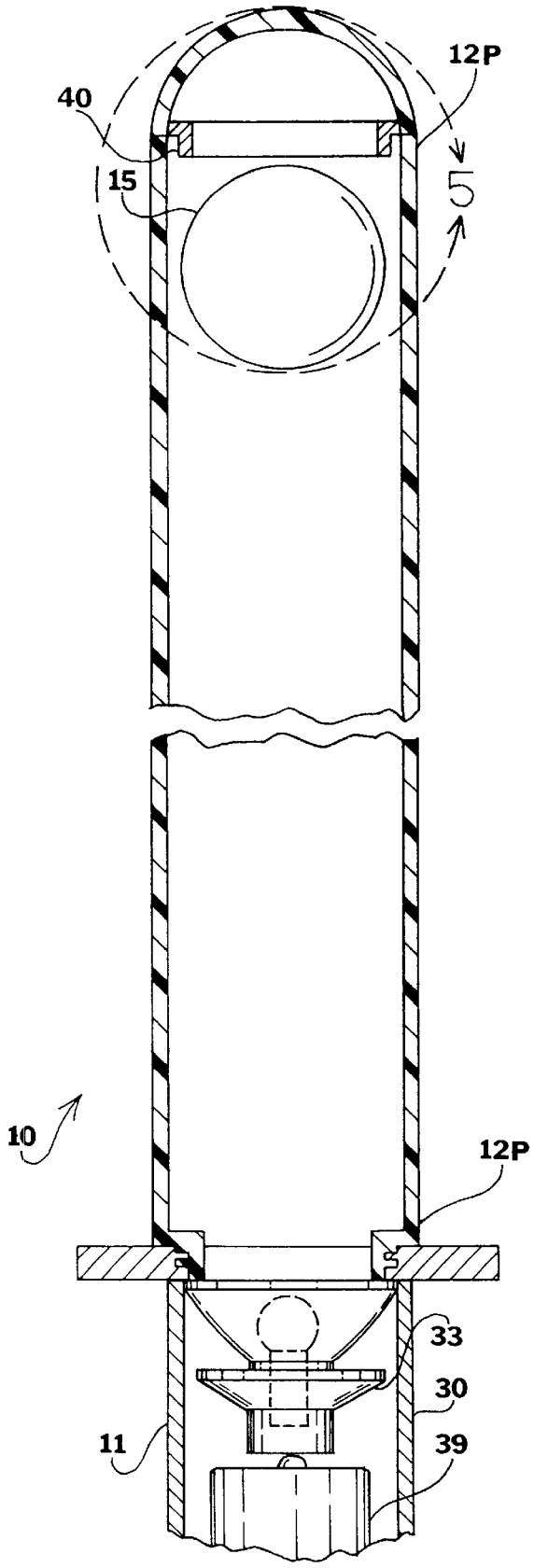
FIG. 4 is a cross sectional view, illustrating the major components of the invention per se.

FIG. 4 illustrates internal details of the light sword toy 10. Notably, within hollow handle 30 of the light source, at least one battery 39 is contained. The battery 39 contacts the reflector assembly 33, in a similar manner as in a conventional flashlight.

Also illustrated, the ball 15 is trapped within the tube 12. A ball retaining mechanism 40 is located at the distal end 12D, and is incorporated with the cap assembly 13. The ball retaining mechanism 40 holds the ball at the distal end of the tube until released.

In use, initially the ball 15 is located near the proximal end 12P. When the light source 11 is activated light emanates from the reflector assembly 33 into the proximal end 12P of the tube 12. Initially when the ball 15 is at the proximal end 12P, it prevents nearly all of the light from reaching the distal end 12P. Thus, the tube will glow brightly near the proximal end 12P, and not at all near the distal end 12D. Then, the tube 12 is tilted downward to allow the ball 15 to roll toward the distal end 12D. As the ball rolls downward, the portion of the light which is blocked by the ball will progressively move toward the distal end 12D. Thus, the tube 12 will progressively get brighter, and the light will appear to move toward the distal end. Thus, to the child playing with the light sword toy 10, it will appear that the "light sword" is being extended for battle. Once the ball reaches the distal end 12D, it is retained thereat by the ball retaining mechanism 40. During play, the ball will remain at the distal end 12D.

After play, the ball is released by the ball retaining mechanism 40, allowing the ball to fall back toward the proximal end 12P, toward the light source. As the ball falls, the light will again be blocked at points distant from the location of the ball, and thus the light will appear to shrink back toward the handle. The light source is then switched off.

The ball retaining mechanism 40 has the following design constraints: it should be capable of catching the ball when it comes into contact therewith, even if it impacts the ball retaining mechanism with only minimal force; it should retain the ball with enough holding power to maintain the ball in position; and it should be selectively releasable by the user preferably by pressing down upon the cap assembly. With the foregoing constraints, design of the actual ball retaining mechanism may be produced without undue experimentation by one of ordinary skill in the art. However, an exemplative ball retaining mechanism is illustrated in FIG. 5.

It should also be hold that the ball 15 should closely match the inside diameter of the tube 12. In this way, the ball 15 would block nearly all of the light from the light source. Therefore, when the ball is rolled from the proximal end toward the distal end, the most dramatic effect would be achieved.

Figure 5:
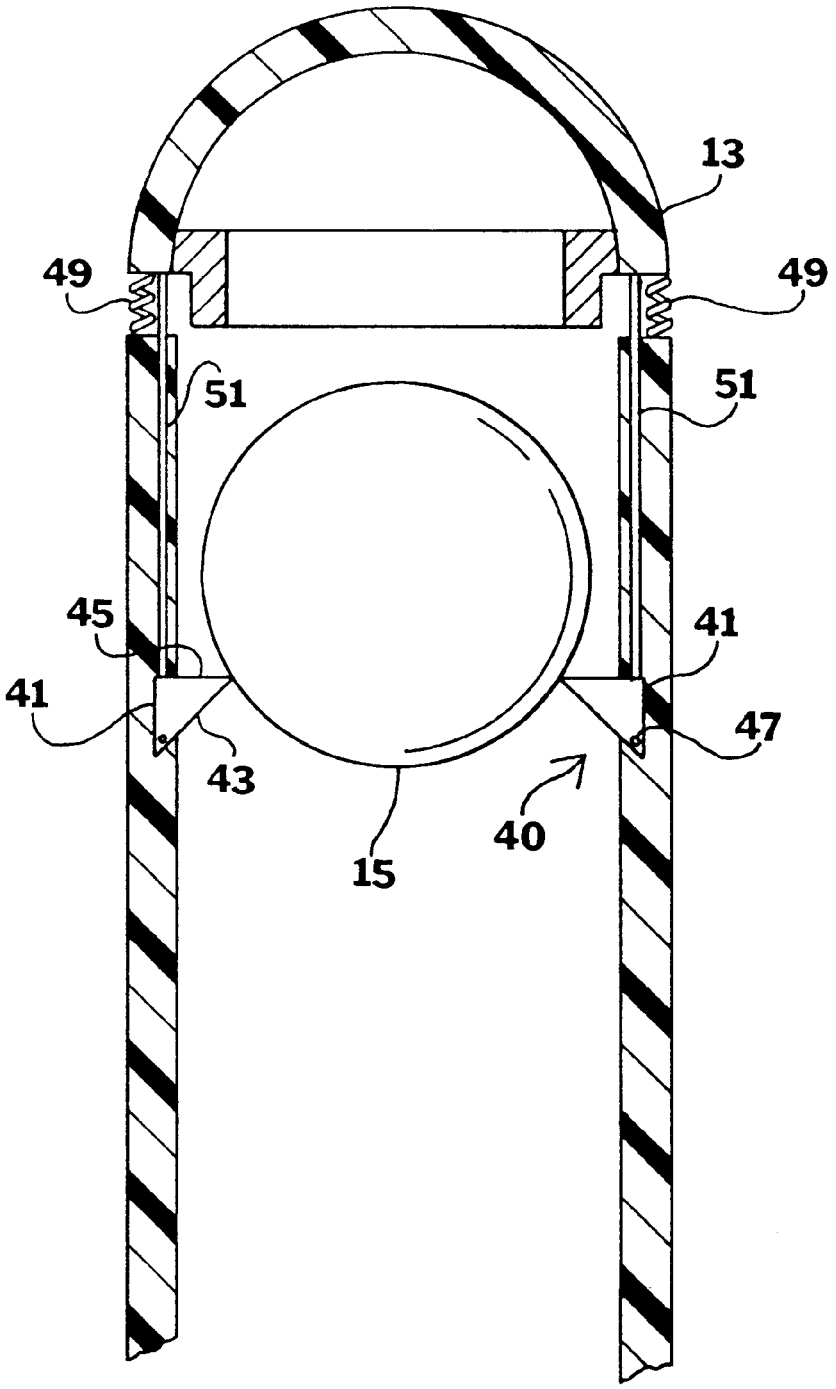
FIG. 5 is a cross sectional view which is an enlargement of circle 5 in FIG. 4, showing an exemplative ball retaining mechanism.
Figure 6:
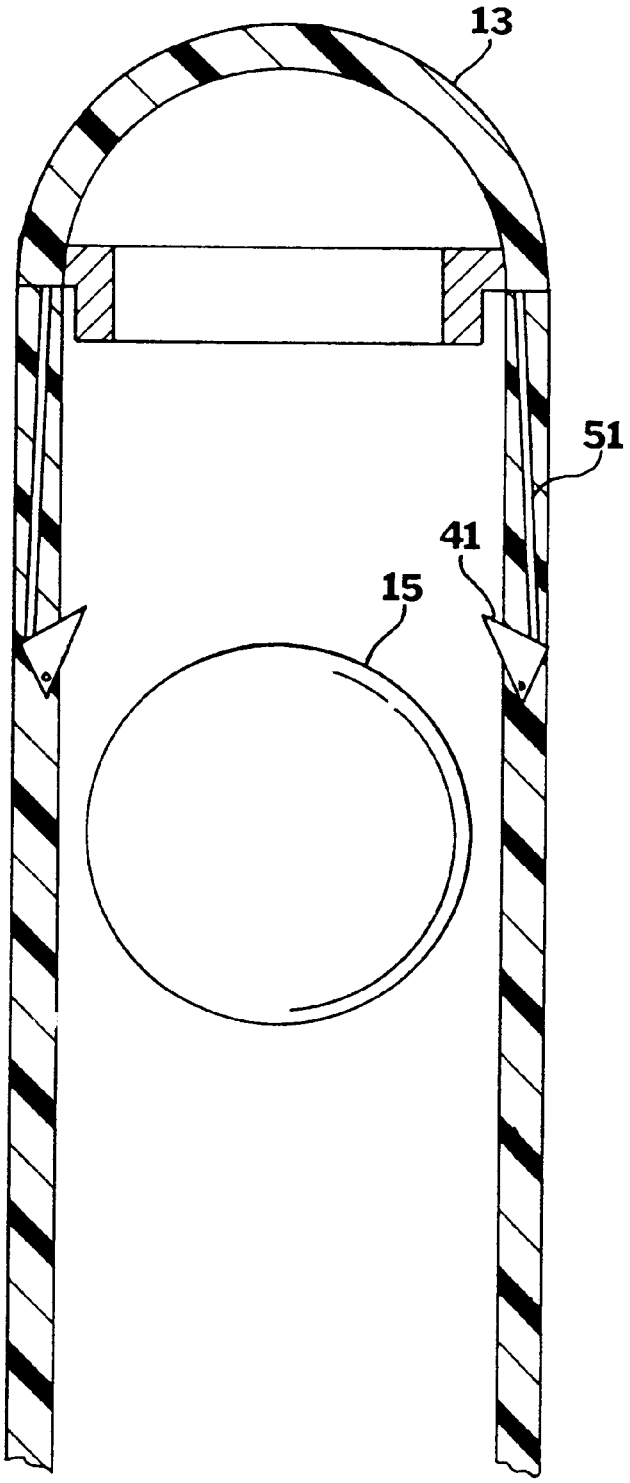
FIG. 6 is a cross sectional view, similar to FIG. 5, illustrating how the ball is released by the exemplative ball retaining mechanism.

In FIG. 5, the ball retaining mechanism 40 comprises a pair of pivot catches 41 located on the tube 12 near the distal end 12D. The pivot catches 41 each have a catch ramp 43 and a catch top 45. The pivot catches 41 each have a pivot point 47 which allows the pivot catches 41 to pivot between the position illustrated in FIG. 5, wherein the pivot catches 41 retain the ball against the catch top 45, and a position illustrated in FIG. 6, wherein the ball is released from the ball retaining mechanism 40. The ball retaining mechanism 40 is incorporated with the cap assembly 13. The cap assembly is mounted to the distal end 12D with springs 49, which bias the cap assembly away from the distal end 12D of the tube 12. A pair of levers 51 connect the cap assembly 13 to the catch top 45 of the pivot catches 41. Referring to FIG. 6, when the cap assembly 13 is pressed downward against the tube 12, the levers 51 pivot the pivot catches 41 to release the ball 15. Once again, the exemplative ball retaining mechanism 40 is illustrative only, and merely represents the best example thereof known to the applicant.

In conclusion, herein is presented a light sword toy which includes a light source and a tube having a proximal end and a distal end. The tube is made of a translucent material, and the light source illuminates the tube and causes it to glow. A ball is contained within the tube and is capable of movement between the proximal end and distal end. When the ball is near the proximal end it nearly all the light from reaching the distal end. Thus, as the ball is rolled toward the distal end, the illumination grows toward the distal end. A ball retaining mechanism holds the ball at the distal end during play.

What is claimed is:

1. A light sword toy, comprising:

a cylindrical tube having an inside diameter, a proximal end and a distal end, the tube made of a translucent material;

a light source attached to the proximal end of the tube, the light source directing light through the tube to cause said tube to glow;

a ball located within the tube having a diameter closely matching the inside diameter of said tube, capable of moving between the proximal end and distal end, to alter illumination of the tube as said ball rolls therein, wherein the ball is opaque and thus blocks nearly all of the light from the light source from reaching the distal end of the tube when the ball is near the proximal end; and a ball retaining means within the tube for selectively holding the ball in a fixed position within the tube, and after release, allowing said ball to roll freely within the tube.

2. The light sword toy as recited in claim 1, wherein the ball retaining means is located at the distal end of the tube, for selectively maintaining the ball at the distal end.

3. The light sword toy as recited in claim 2, further comprising a cap assembly mounted at the distal end of the tube, the ball retaining means integrated with the cap assembly.

4. The light sword toy as recited in claim 3, wherein the ball retaining means releases the ball when the cap assembly is pressed.

5. A light sword toy method, using a light sword toy having a light source and a tube having a proximal end and a distal end, the proximal end connected to the light source such that the light source can direct light into the tube toward the distal end, the toy further having an opaque ball contained within the tube, the ball movable between the proximal end and distal end, and a ball retaining means within the tube, comprising the steps of:

positioning the ball at the proximal end of the tube;

activating the light source to emanate the light toward the distal end of the tube;

blocking a portion of the light with the ball;

rolling the ball toward the distal end of the tube to allow tube illumination to progress toward the distal end;

catching the ball in the ball retaining means; and retaining the ball in the ball retaining means.

6. The light sword toy method as recited in claim 5, wherein the ball retaining means is located at the distal end, and further comprising the step of:

releasing the ball from the ball retaining means by the user.

* * * * *